US005174734A

United States Patent [19]

Thomas et al.

[11] Patent Number: 5,174,734

[45] Date of Patent: Dec. 29, 1992

[54] FUEL PUMPING APPARATUS

[75] Inventors: Gerald S. Thomas; Brian L. Maxey; James M. A. Askew, all of Gloucester, England

[73] Assignee: Lucas Industries public limited company, West Midlands, England

[21] Appl. No.: 706,270

[22] Filed: May 28, 1991

[51] Int. Cl.[5] ..... F04B 7/04

[52] U.S. Cl. ..... 417/490; 403/302

[58] Field of Search ..... 417/490; 403/300, 302

[56] References Cited

U.S. PATENT DOCUMENTS

| | | | |
|---|---|---|---|
| 4,017,934 | 4/1977 | Callahan | 403/302 |
| 4,269,176 | 5/1981 | Beyer et al. | 403/300 |
| 4,286,931 | 9/1981 | Hafele et al. | 417/490 |
| 4,728,269 | 3/1988 | Hafele | 417/490 |
| 4,842,496 | 6/1989 | Hafele | 417/490 |

FOREIGN PATENT DOCUMENTS

| | | | |
|---|---|---|---|
| 2429787 | 1/1975 | Fed. Rep. of Germany | 417/490 |

*Primary Examiner*—Richard A. Bertsch
*Assistant Examiner*—Michael I. Kocharov
*Attorney, Agent, or Firm*—Trexler, Bushnell, Giangiorgi & Blackstone, Ltd.

[57] ABSTRACT

A reciprocal plunger fuel injection pump has a plunger having an enlarged head at one end. A spring abutment is secured to the head, and has a flange for engagement by the plunger return spring and a surface engageable with the end of the plunger. A spring clip has an apertured base portion engaged beneath the head of the plunger and arms which extend at right angles to the base portion. Some of the arms are turned inwardly to define a hook portion which locate in a groove formed in the spring abutment thereby securing the abutment to the plunger.

2 Claims, 3 Drawing Sheets

PRIOR ART

FUEL PUMPING APPARATUS

Figure 1:
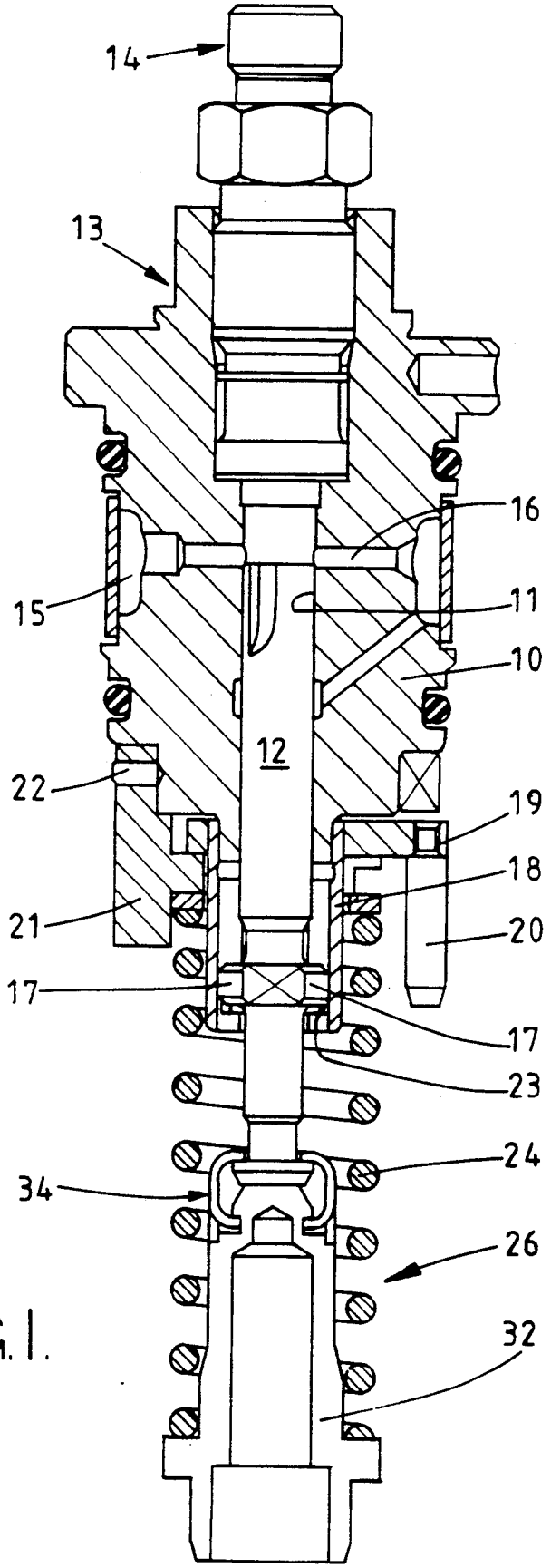

This invention relates to fuel pumping apparatus for supplying fuel to an internal combustion engine and of the kind comprising a body part, a bore formed in the body part, a plunger slidably mounted in the bore and extending from one end thereof, a spring abutment detachably secured to the plunger and a coiled compression spring having one end engaging the spring abutment and acting to urge the plunger in a direction outwardly of the bore, the plunger in use being moved inwardly by a force acting on the spring abutment and developed by an engine driven cam.

Such apparatus is well known in the art and is intended to be mounted on the engine structure. The connection between the plunger and the spring abutment must be positive in the sense that a part of the spring abutment must engage the plunger to transmit the force required to effect inward movement of the plunger and a further part of the spring abutment must engage the plunger to allow the force exerted by the spring to move the plunger outwardly.

For ease of assembly it is desirable for the point of connection between the plunger and the spring abutment to be adjacent the end of the spring remote from the body. However, there is a limit to the length of plunger which can be allowed to extend from the bore. If the extended length of the plunger is increased there is an increased risk of seizure of the plunger in the bore and also an increased risk of plunger breakage during the use of the apparatus. In some forms of apparatus the spring has to be of substantial length and in such cases the point of connection between the spring abutment and the plunger lies well within the spring and this makes assembly difficult. One known form of connection comprises an enlarged head on the plunger which is engaged by the spring abutment to move the plunger inwardly. The spring abutment defines a hook portion which engages the underside of the head to transmit the force exerted by the spring to the plunger. The hook portion is of "C" shaped form to partly embrace the shank of the plunger beneath the head. With this construction it has been found necessary to insert a pin in the spring abutment, the pin extending through the abutment to lie adjacent the head of the plunger in order to prevent the hook portion becoming detached from the plunger during transportation of the apparatus and its assembly to the engine. The need to provide the pin adds considerbly to the cost of the apparatus.

The object of the present invention is to provide an apparatus of the kind specified in a simple and convenient form.

According to the invention in an apparatus of the kind specified the spring abutment is formed in two parts, the first part defining a seating surface for the spring and a surface for engagement with the end of the plunger and the second part being in the form of a clip having an apertured base portion which can be engaged with an enlarged head at the end of the plunger and a plurality of arms which extend generally at right angles to the base portion and at least some of which are turned inwardly to define hook portions for engagement within a circumferential groove formed in the first part, the first part of the spring abutment intermediate the groove and said surface being tapered to permit the two parts of the spring abutment to be engaged by generally axial movement.

Figure 2:
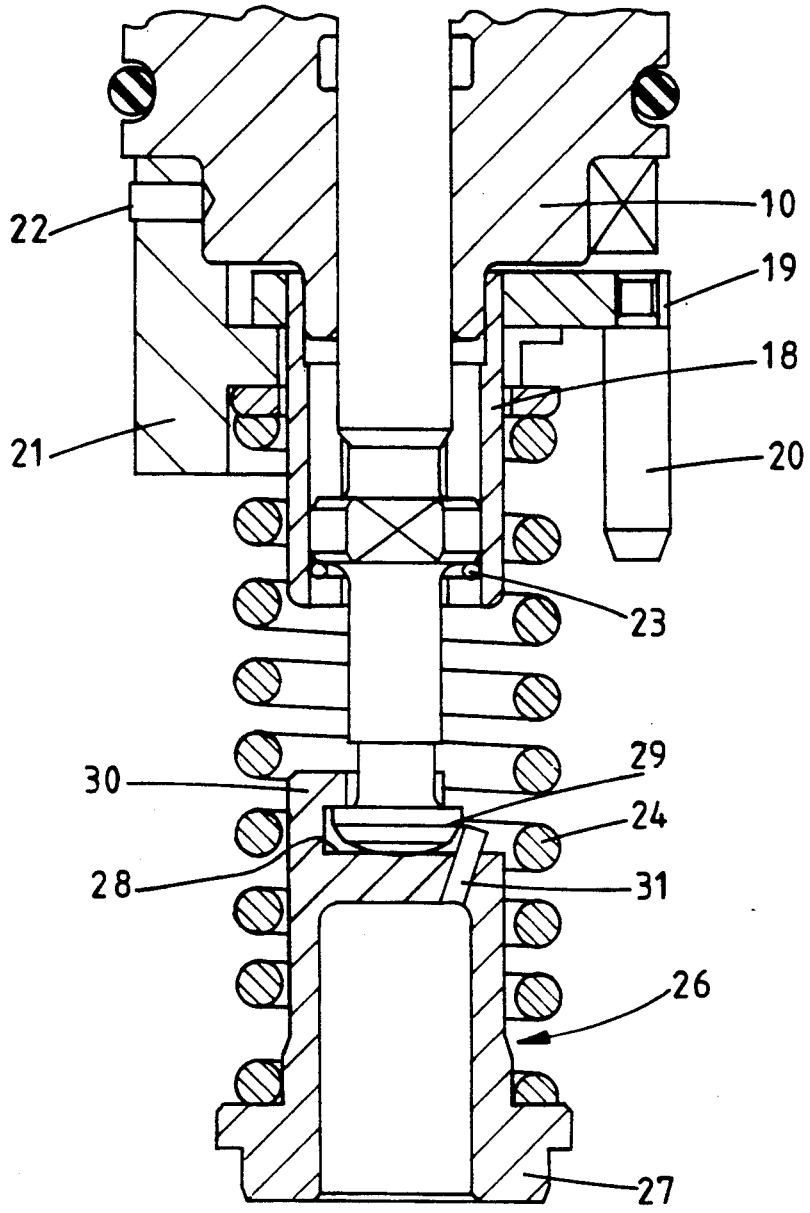
Figure 3:
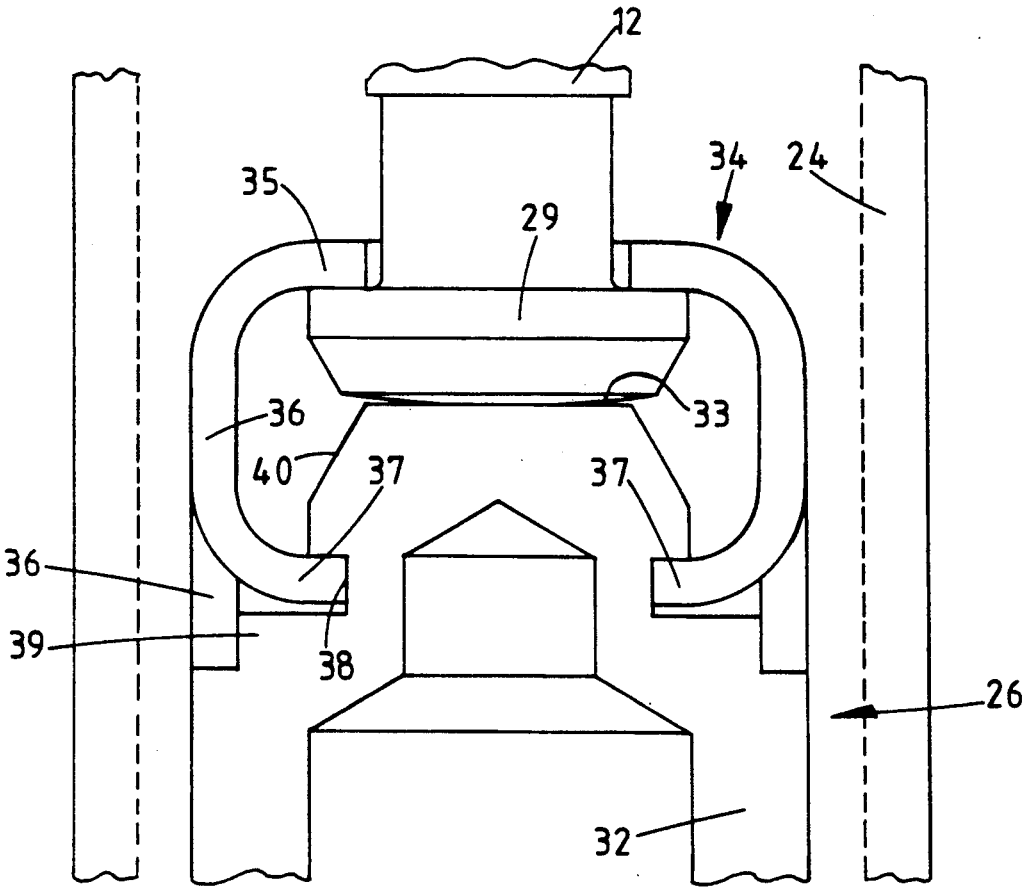
Figure 4:
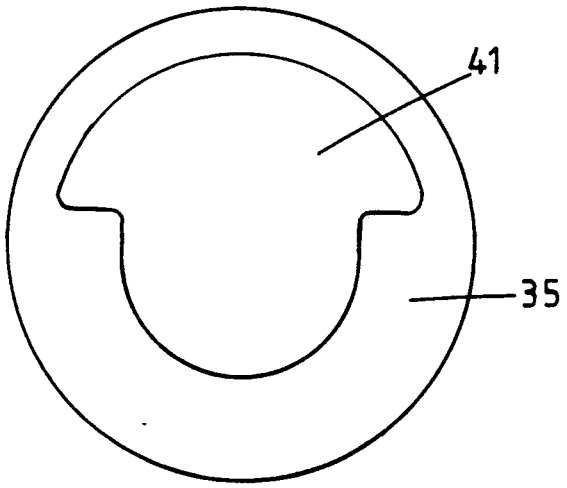

In the accompanying drawings: FIG. 1 is a sectional side elevation of a fuel pumping apparatus in accordance with the invention, FIG. 2 is a view similar to FIG. 1 to an enlarged scale but showing part of a known form of apparatus, FIG. 3 is a view to an englarged scale of part of the apparatus seen in FIG. 1 and FIG. 4 is a plan view of part of the apparatus seen in FIGS. 1 and 3.

Referring to FIG. 1 of the drawings the apparatus comprises a body part 10 of generally stepped cylindrical form within which is formed a bore 11. Slidable within the bore is a plunger 12 which extends from one end of the bore. The other end of the bore is closed by a delivery valve assembly 13 which includes an outlet union 14 for connection in use, to a fuel injection nozzle of an associated engine.

In the periphery of the body part there is formed a groove 15 which receives fuel at low pressure and extending inwardly from the groove are a pair of ports 16 opening into the bore 11. The ports 16 are covered during the initial inward movement of the plunger and thereafter fuel is delivered to the associated engine until such time as a groove formed on the periphery of the plunger is brought into register with one of the ports 16. When such registration has been established further inward movement of the plunger results in displacement of fuel from the bore through the one of the ports 16 with which the groove communicates and the supply of fuel to the associated engine ceases. During outward movement of the plunger when the ports 16 are uncovered, fuel can flow into the bore ready for the next delivery of fuel to the associated engine.

The aforesaid groove on the plunger has an inclined control edge and in known manner the plunger is angularly adjustable so as to be able to control the amount of fuel which is supplied to the associated engine.

The extended portion of the plunder is provided with axially extending lateral tongues 17 which are located within axial slots formed in the internal peripheral surface of an angularly adjustable sleeve 18. The sleeve 18 is provided with an outwadly extending arm 19 to which is secured a peg 20 which in use, is coupled to a governor mechanism.

The sleeve is retained against the body part by means of a retaining member 21 which is secured to the body part by means of a pin 22. By moving the sleeve angularly the angular position of the plunger can be controlled. The extent of outward movement of the plunger is limited by an abutment in the form of a circlip 23 which engages with the tongues 17 thereby to prevent the plunger falling out of the bore during transportation and assembly of the apparatus to the associated engine.

Outward movement of the plunger is effected by a coiled compression spring 24. One end of the spring 24 engages a surface defined by a washer located against the retaining member 21 and the other end of the spring engages a spring abutment generally indicated at 26.

Turning now to FIG. 2 this shows a known form of apparatus. The spring abutment 26 comprises a generally cylindrical member 27 having a flange which is engaged by the spring 24. The cylindrical member defines a cylindrical recess and the member extends within the spring to define a surface 28 for engagement with the end of the plunger, the latter being provided with an enlarged head 29. The spring abutment also defines a hook portion 30 which is engagable with the underside of the head 29 and in plan view, is of "C" shaped form.

The hook portion serves to transmit the force exerted by the spring to the plunger. In order to prevent detachment of the hook portion from the enlarged head 29, a pin 31 is located within a drilling formed in the cylindrical member 27, the pin engaging the side of the head 29 to prevent the hook portion 30 becoming disengaged from the plunger. The provision of the pin which involves drilling an inclined hole in the member 29 adds considerably to the cost of the apparatus and the assembly of the pin within the drilling is not easy.

Turning again to FIG. 1 and also to FIG. 3, the spring abutment 26 comprises a part 32 which is of cylindrical form and defining a flange for engagement by the end of the spring 24. The part 32 extends within the spring and its end surface 33 is engaged with the head 29 of the plunger. Also provided is a spring clip 34, and this comprises a base portion 35 which is indicated in plan view in FIG. 4, and extending generally axially from the base portion 35 are a plurality of angularly spaced arms 36. In the example alternate ones of the arms 36 are turned inwardly to define hook portions 37 and these when the spring clip is assembled on the spring abutment located within a circumferential groove 38 which is spaced rearwardly from the surface 33. The remaining arms 36 extend axially and locate about a cylindrical portion 39 of the part 32. Thus when the spring clip 34 and the spring abutment are assembled, the inwardly turned arms 36 transmit the force exerted by the spring 24 to the head 29 of the plunger so as to move the plunger outwardly.

In order to facilitate engagement of the hook portions 37 in the groove 38, the surface of the portion of the part 32 lying between the groove 38 and the surface 33 is tapered as indicated at 40 so that during axial engagement of the spring clip and the part 32, the arms 36 carrying the hook portions are urged outwardly by the tapered surface 40 and then clip into the groove 38.

The shape of the aperture 41 in the base portion 35 of the spring clip is important and it is such that when in position, the base portion cannot be disengaged from the plunger even if there is relative lateral movement between the spring abutment 26 and the plunger. The aperture is therefore shaped so that the base portion 35 can only be engaged beneath the head 29 of the plunger by tilting the base portion and feeding the head of the plunger through the aperture.

The portion of the plunger which lies immediately adjacent the head is of reduced diameter as compared with the rest of the plunger and therefore during the process of engagement of the two parts of the spring abutment, it is necessary to pass a suitably shaped reaction member between adjacent coils of the spring so that axial force can be imparted between the spring clip 34 and the spring abutment.

If desired all the arms 36 can be turned inwardly to form hook portions 37 alternatively a selected few instead of alternate ones can be left in the straight condition.

We claim:

1. A fuel pumping apparatus for supplying fuel to an internal combustion engine comprising a body part, a bore formed in the body part and a plunger mounted in the bore and having a portion extending from the bore, an enlarged head formed at the end of the extending portion of the plunger, a spring abutment detachably secured to the plunger and a coiled compression spring having one end engaging the spring abutment and acting to urge the plunger out of the bore, and end surface defined on the spring abutment for engagement with the plunger, the plunger in use being driven inwardly by a force acting on the spring abutment and transmitted to the plunger by way of said surface, a circumferential groove defined in the spring abutment, the groove being axially spaced from said end surface, and a portion of the spring abutment which is disposed between said end surface and the groove being tapered inwardly from the groove to the end surface, and a spring clip acting to retain the spring abutment and the plunger in assembly, the spring clip having an apertured base portion which can be engaged with the enlarged head of the plunger and a plurality of arms extending generally at right angles to the base portion, at least some of said arms being turned inwardly to defined hook portions for engagement within said circumferential groove.

2. An apparatus according to claim 1, in which the arms which are not turned inwardly lie against a portion of the spring abutment.

* * * * *